US005614784A

United States Patent [19]

Harzig et al.

[11] Patent Number: 5,614,784

[45] Date of Patent: Mar. 25, 1997

[54] DISCHARGE LAMP, PARTICULARLY COLD-START FLUORESCENT LAMP, AND METHOD OF ITS MANUFACTURE

[75] Inventors: Christian Harzig, Mering; Roland Hoffmann, Augsburg; Erolf Weinhardt, Diedorf, all of Germany

[73] Assignee: Patent-Treuhand-Gesellschaft für elektrische Glühlampen mbH, Munich, Germany

[21] Appl. No.: 490,863

[22] Filed: Jun. 15, 1995

Related U.S. Application Data

[63] Continuation of Ser. No. 122,015, Sep. 15, 1993, abandoned.

[30] Foreign Application Priority Data

Oct. 15, 1992 [DE] Germany ..... 42 34 843.9

[51] Int. Cl.[6] ..... H01J 9/04

[52] U.S. Cl. ..... 313/491; 313/346 R; 313/346 DC; 445/51

[58] Field of Search ..... 313/346 R, 491, 313/346 DC; 445/51

[56] References Cited

U.S. PATENT DOCUMENTS

| | | | |
|---|---|---|---|
| 3,719,856 | 3/1973 | Koppius | 313/346 DC |
| 3,758,809 | 9/1973 | Menelly | 313/346 R |
| 3,766,423 | 10/1973 | Menelly | 313/311 |
| 3,798,492 | 3/1974 | Menelly | 313/346 R |
| 3,837,909 | 9/1974 | Menelly | 427/67 |
| 3,842,469 | 10/1974 | Menelly | 445/51 |
| 3,969,279 | 7/1976 | Kern | 252/521 |
| 4,031,426 | 6/1977 | Kern | 313/346 R |
| 4,319,158 | 3/1982 | Watanabe et al. | 313/346 R |
| 4,836,816 | 6/1989 | Bouchard et al. | 445/51 |
| 4,897,574 | 1/1990 | Saito et al. | 313/346 R |
| 5,233,268 | 8/1993 | Heuvelmans et al. | 313/491 |
| 5,256,095 | 10/1993 | Takegawa et al. | 445/6 |
| 5,334,085 | 8/1994 | Shroff | 445/51 |

FOREIGN PATENT DOCUMENTS

| | | | |
|---|---|---|---|
| 54-060777 | 5/1979 | Japan | H01J 9/04 |
| 967273 | 8/1964 | United Kingdom | H01J 1/20 |
| 2095893 | 10/1982 | United Kingdom | H01J 1/20 |

OTHER PUBLICATIONS

G. Herrmann & S. Wagener, "The oxide–coated cathode", 1951, Chapman & Hall Ltd., London, vol. 1, pp. 27, 32, 54–73, 135, 137.

G. Herrmann & S. Wagener, "The oxide–coated cathode", 1951, Chapman & Hall Ltd., London, vol. 2, pp. 150, 155, 156, 169.

*Primary Examiner*—Alvin F. Oberley
*Assistant Examiner*—Lawrence D. Richardson
*Attorney, Agent, or Firm*—Frishauf, Holtz, Goodman, Langer & Chick, P.C.

[57] ABSTRACT

The lifetime of cold-start fluorescent lamps is increased, and the ability to withstand repeated ON-OFF switching cycles enhanced by coating the electrodes with an emitter which consists of barium oxide and a small portion of metallic barium and, optionally, up to 20 mol-% of strontium oxide and a small portion of metallic strontium, preferably only up to about 5 mol-% of strontium oxide—metallic strontium. To make the emitter, barium carbonate, optionally mixed with strontium carbonate, is applied in paste form to the electrodes which, when coated, are introduced into an envelope and sealed therein. The envelope is then evacuated, and the electrodes are heated, thus converting the barium carbonate to barium oxide and metallic barium, and the strontium carbonate, if present, to strontium oxide and metallic strontium, so that the electrodes will be coated with barium oxide, optionally strontium oxide, and metallic barium and optionally metallic strontium. The evacuation and activating step can be carried out essentially simultaneously, by evacuating the envelope through a pump tube and heating the electrodes to above about 800° C. by passing a current pulse therethrough.

8 Claims, 1 Drawing Sheet

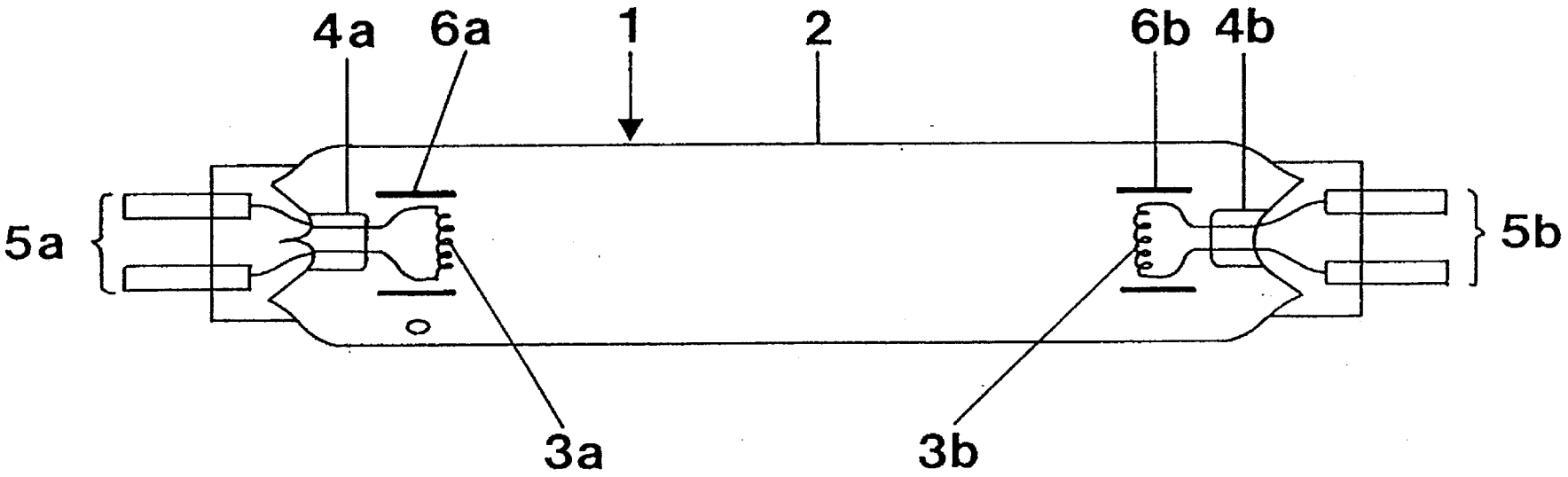
5b
4b
6b
3b
2
1
3a
6a
4a
5a

DISCHARGE LAMP, PARTICULARLY COLD-START FLUORESCENT LAMP, AND METHOD OF ITS MANUFACTURE

This application is a continuation of application Ser. No. 08/122,015, filed Sep. 15, 1993 now abandoned.

Reference to related literature "DIE OXYDKATHODE" (Vol. 2, by G. Herrmann and S. Wagener, Johann Ambrosius Barth, publishers, Leipzig, 2nd printing (1950), pages 25–39 and 137–138, an English translation of which is available as "The Oxide-Coated Cathode", Chapman and Hall Ltd., London (1951), Vol. 1, pp. 27, 32, 54–73, 135, 137; Vol. 2, pp. 150, 156, 169.

FIELD OF THE INVENTION

The present invention relates to discharge lamps, and more particularly to low-pressure discharge lamps, and especially to cold-start fluorescent lamps, and to a method of making such lamps. The invention is especially directed to the electrodes, and particularly to the electron emitter pastes, for such discharge lamps, which otherwise may be of conventional construction.

BACKGROUND

Fluorescent lamps, that is, low-pressure discharge lamps, customarily use double-coiled or coiled-coil electrodes which are held in electrode mounts so as to be essentially rod or pin-like, located effectively transversely to the longitudinal axis of the usually elongated fluorescent lamp. Double-coiled or coiled-coil filaments are well known in lamp technologies. The double-coiled filaments are activated by being coated with a mixture of barium and strontium carbonate. It has been known to utilize such a mixture in which approximately equal values of strontium carbonate and barium carbonate are used. The emission values of such mixtures have been considered an optimum. An equimolar mixture of barium carbonate and strontium carbonate, to which approximately 10% of calcium carbonate is added, also gives good emission values after the electrodes have been activated. In the activation process, the carbonates are converted into corresponding metal oxides. Electrodes of this type are described in the referenced literature, "DIE OXYDKATHODE" ("THE OXIDE CATHODE"), Vol 2, by G. Herrmann and S. Wagener, Johann Ambrosius Barth, publishers, Leipzig, 2nd printing (1950), pages 25–33 and 137–138.

Emitter coating compositions as known can be used not only for fluorescent lamps with heated cathodes but can also be used for cold-start fluorescent lamps. Cold-start fluorescent lamps are lamps which do not require pre-heating of the electrode windings.

The electrode windings are extremely highly loaded upon cold-starting of fluorescent lamps when the lamps are energized, that is, upon initial ignition. First, a glow phase results, in which the electrode windings are subjected to an intense ion bombardment, leading to heating of the electrodes and formation of a hot spot or discharge spot on the electrode filament windings, from which, then, the transition to the arc discharge occurs. The ion bombardment results in damage to the electrode windings by sputtering-off of electrode material and emitter material. This sputtered-off material deposits or precipitates on the inner wall of the discharge envelope, typically an elongated, straight or bent tube, resulting in undesired blackening at the ends of the discharge envelope. Extended glow phases, further, may lead to premature breakage of the electrode winding, thus reducing the lifetime of the fluorescent lamp.

THE INVENTION

It is an object to provide a discharge lamp, and especially a low-pressure discharge lamp, having improved cold-starting characteristics, and a method to make such lamps, and particularly the electrodes, and electrode coating material therefor.

Briefly, the electrodes are coated with an electron emission paste which consists essentially of barium oxide and a small portion of metallic barium or of a barium oxide—strontium oxide mixture and a small portion of metallic barium and metallic strontium, in which the strontium carbonate, and metallic strontium, respectively, is present in up to about 20 mol-%, and preferably only up to about 5 mol-%.

The lamp can be made in accordance with well-known and customary manufacturing procedures; during an activation phase of electrodes coated with barium carbonate and, optionally, up to 20% and preferably up to 5% strontium carbonate, by heating to convert the metallic carbonates to metallic oxides, oxygen is withdrawn to enrich the respective metallic oxides and leave actual metallic barium and, optionally, strontium in the emitter. Thus, the barium oxide—optionally with the strontium oxide—emitter contains a small portion of metallic barium and, optionally, metallic strontium.

Experiments in which emitter pastes made of pure barium carbonate are used in rod-shaped, double-coiled electrodes in fluorescent lamps have shown, surprisingly, that such fluorescent lamps after activation of the electrodes have substantially improved cold-start characteristics and lifetimes, when compared with the electrodes of the prior art, as discussed above. Using a pure barium oxide emitter, with a small portion of metallic barium, also has better adhesion on tungsten electrode wires than the previously used standard emitter. It delivers sufficient electrons by electron emission to operate the lamp. Low-pressure discharge lamps, such as fluorescent lamps, could be cycled to more than 10,000 ON-OFF switching cycles without resulting in damage to the electrode filaments, or in any material blackening of the discharge vessel.

Experiments have also shown that low-pressure discharge lamps having electrodes in accordance with the present invention can be improved by adding strontium carbonate to the emitter paste, but only in a the emitter paste minor proportion. Increasing the addition of strontium carbonate decreases the resistance of the lamp to repeated switching cycles, and blackening of the discharge envelope increases since the emitter material has an increased tendency to sputter. It has been found, by experiments, that about 20 mol-% of strontium carbonate in the emitter paste is the upper limit to obtain sufficient cold-start capability for lamps in commercial use. Particularly good results were obtained when the percentage of strontium carbonate was up to only about 5 mol-%; the remainder of the emitter paste was barium carbonate. The pure barium carbonate, forming the starting material for the emitter paste, should, preferably, have an average grain size of between 3 μm and 8 μm.

The electrodes coated with the emitter paste in accordance with the invention can be used in many commercial fluorescent lamps of various types. It is also possible to use the emitter paste in sodium high-pressure discharge lamps.

In the specification and claims, are parts are per weight, unless otherwise specified.

DRAWING

The single figure is a highly schematic longitudinal side view of a fluorescent lamp, in which the phosphor coating is deemed to be transparent.

DETAILED DESCRIPTION

The invention will be described with reference to an elongated tubular fluorescent lamp although, of course, it is applicable to many other types of lamps as well.

Referring to the drawing: A tubular elongated fluorescent lamp 1 has a tubular discharge vessel which, in cross section, is circular-cylindrical. The diameter of the lamp can vary and, for example, may be about 26 mm; the length of the lamp can vary between 0.6 m and 1.5 m. Two coiled-coil or double-coiled rod-shaped, or rod-like, or stick-shaped electrode filaments *3a, 3b*, made of tungsten wire, are melt-sealed in melt seals *4a, 4b* at the ends of the discharge vessel, and terminate in base connecting pins *5a, 5b*. The rod-like, or rod-shaped, or stick-shaped electrode windings are located transversely to the discharge path between the electrodes, defined within the discharge vessel. The interior of the tubular envelope is coated with a fluorescent material, typically a phosphor. An ionizable fill is retained in the discharge envelope. The fill, in operation, is, as is customary, a mixture of mercury vapor and a noble gas, for example argon. To permit quick-starting, the electrode filament windings of the electrodes *3a, 3b* are coated with an emitter paste.

In accordance with a feature of the invention, the emitter paste is made of barium oxide, which contains a small portion of metallic barium, formed during the generation process of the barium oxide emitter.

In accordance with a feature of the invention, the emitter may, further, contain a minor amount of strontium oxide and metallic strontium.

Method of making the low pressure discharge lamp, and preparation of the electron emitter paste:

The discharge envelope is made of a glass tube, which is coated with a fluorescent "mud" at the inside thereof, to leave a coating on the glass tube. After burning-out binder of the "mud" electrode mounts including the filaments coated with emitter paste are introduced into the ends of the discharge vessel and melt-sealed therein. One or both of the electrode mounts may include small exhaust tubes, which permit pumping to reduce contaminants of the interior of the envelope, flushing of the envelope or the like. The envelope is evacuated and, during evacuation, the electrodes are activated at the same time by connecting the external leads *5a, 5b* to a current source, to heat the electrodes. Then, an ionizable fill is introduced into the discharge envelope. The fill may be crypton, argon, and mercury. Thereafter, the pumping stubs or tubes—not shown in the drawing for simplicity and well known—are tipped off and the lamp is sealed.

The electrode mounts, apart from their glass support which can be conventional, are formed of a double-coiled tungsten wire. The current supply leads are melt-sealed in the ends *4a, 4b* of the lamp or in a separate lamp mount, leaving the external connections *5a, 5b*. Electrode shields *6a, 6b* may be provided but are not strictly necessary; they can be secured to the electrode mounts.

The emitter paste which is applied on the electrode windings is barium carbonate which, during activation, is converted into barium oxide with a small portion of metallic barium.

The electron emitter paste is made in a precipitation apparatus, using as starting materials barium nitrate and a tartrate, preferably potassium sodium tartrate, from which, after heating to glowing temperature, barium carbonate is obtained. The barium carbonate is dried and then ground together with butylacetate and nitrocellulose. The grinding or milling is carried out until the average grain size of the barium carbonate powder in the suspension is about 5 μm. The suspension is formed of about 80% $BaCO_3$, 18% butylacetate and 2% nitrocellulose, all percentages by weight. Before melting-in of the electrodes into the discharge envelope, the electrode windings or filaments are coated with the emitter paste, or suspension, respectively, for example by dipping the electrode filaments into the suspension.

To activate the electrode windings, coated with the emitter paste, the electrode windings are subjected to electrical current of from about 10–40 seconds, to heat them to a temperature above 800° C. This burns off the binder, and the barium carbonate is converted into barium oxide.

In addition to the burning-off, and upon withdrawal of oxygen, a small portion of the barium oxide is reduced to metallic barium. The metallic barium increases the electrical conductivity of the barium oxide, which is semiconducting, and has a substantial influence on the electron emission of the barium oxide emitter.

Various changes and modifications may be made. For example, rather than using essentially only barium carbonate, a mixed carbonate formed of barium carbonate and of from between 0 and 5 mol-% of strontium carbonate, can be used to form the emitter paste. After activation, the electron emitter will be a mixed oxide, namely barium oxide and strontium oxide, and a minor portion of metallic barium as well as metallic strontium. The proportion of metallic barium to barium oxide or of metallic barium and strontium to the barium oxide—strontium oxide mixture is about 0.05 mol-%. The relationship of barium oxide to strontium oxide in the electron emitter is exactly the same as the relation of barium carbonate to strontium carbonate in the emitter paste.

The emitter can be used not only in the lamp as shown and specifically described, but in many commercial fluorescent lamps, as well as in sodium high-pressure lamps.

Other solvent or suspension and binder systems may be used; for example, an aqueous suspension is also suitable.

We claim:

1. A discharge lamp, optionally a low-pressure discharge lamp, having an elongated discharge envelope (2) defining a discharge path;

two activated electrodes (*3a, 3b*) located at end regions and melt-sealed into the discharge envelope, said electrodes being double-coiled, essentially rod shaped filaments, of tungsten wire and located transversely with respect to the discharge path;

an electron emitter coated on the electrodes; and an ionizable fill retained in the discharge envelope, wherein, in accordance with the invention, the electron emitter essentially consists of barium oxide and up to about 20 mol-% of strontium oxide, wherein the oxides contain a small portion of metallic barium and metallic strontium, respectively, due to activation of the electrodes.

2. The lamp of claim 1, wherein the small portion of metallic barium and metallic strontium, together, are about 0.05 mol-% of the barium oxide, and strontium oxide, respectively.

3. A method to make a discharge lamp, optionally a low-pressure discharge lamp, having an elongated discharge envelope (2) defining a discharge path;

two activated electrodes (3*a*, 3*b*) located at end regions and melt-sealed into the discharge envelope, said electrodes being double-coiled, essentially rod shaped filaments, of tungsten wire and located transversely with respect to the discharge path;

an electron emitter coated on the electrodes; and an ionizable fill retained in the discharge envelope, wherein, the electron emitter essentially consists of barium oxide and up to about 20 mol-% of strontium oxide, and wherein the respective oxides contain, respectively, a small portion of metallic barium, optionally about 0.05 mol-% of the barium oxide, and metallic strontium, optionally about 0.05 mol-% of the strontium oxide;

said method comprising the steps of:

(a) providing a suspension of barium carbonate and strontium carbonate and a binder to form an emitter paste, wherein the proportion of strontium carbonate in the mixture is up to about 20 mol-%;

(b) applying the emitter paste on the electrodes to coat the electrodes therewith;

(c) melt-sealing the thus coated electrodes into the discharge envelope (2);

(d) evacuating the discharge envelope;

(e) activating the coated electrodes (3*a*, 3*b*) to form said electron emitter, said activating step including (e1) burning off the binder;

(e2) converting the barium carbonate to barium oxide and metallic barium and the strontium carbonate to strontium carbonate and metallic strontium by withdrawing oxygen from the emitter to thus enrich the barium oxide and strontium oxide and form metallic barium and metallic strontium;

(f) introducing an ionizable fill into the discharge envelope (2); and (g) sealing the discharge envelope (2).

4. The method of claim 3, wherein said step (a) comprises:

(a1) in a precipitation apparatus, precipitating barium nitrate and strontium nitrate to form a barium carbonate—strontium carbonate mixture;

(a2) drying the barium carbonate—strontium carbonate mixture;

(a3) mixing together 80 parts of the barium carbonate—strontium carbonate mixture, 18 parts of butylacetate, and 2 parts nitrocellulose, thereby forming the emitter paste for the electrode.

5. The method of claim 3, wherein the mixture of barium carbonate and strontium carbonate contains about 5 mol-% of strontium carbonate.

6. The method of claim 3, including the step of milling the barium carbonate—strontium carbonate mixture in the emitter paste until the mixture has an average grain size of between about 3 μm to 8 μm, optionally about 5 μm.

7. The method of claim 3, wherein the steps (d) and (e1) and (e2) are carried out essentially simultaneously in a single evacuation and heating step.

8. The method of claim 7, wherein steps (e1) and (e2) include heating the electrodes to a temperature of at least about 800° C.

* * * * *